US006265717B1

(12) United States Patent
Sakata et al.

(10) Patent No.: US 6,265,717 B1
(45) Date of Patent: Jul. 24, 2001

(54) INDUCTIVELY COUPLED PLASMA MASS SPECTROMETER AND METHOD

(75) Inventors: Kenichi Sakata; Noriyuki Yamada; Ryotaro Midorikawa, all of Tokyo (JP); James Charles Wirfel, Lincoln University, PA (US); Donald Lee Potter, Cheshire (GB); Abelardo Gabriel Gutierre Martinez, Wilmington, DE (US)

(73) Assignee: Agilent Technologies, Santa Clara, CA (US)

( * ) Notice: Subject to any disclaimer, the term of this patent is extended or adjusted under 35 U.S.C. 154(b) by 0 days.

(21) Appl. No.: 09/207,564

(22) Filed: Dec. 8, 1998

(51) Int. Cl.[7] ..... H01J 49/26; H01J 49/24

(52) U.S. Cl. ..... 250/289; 250/288; 250/281; 250/282

(58) Field of Search ..... 250/288, 281, 250/282, 289

(56) References Cited

U.S. PATENT DOCUMENTS

| | | | | |
|---|---|---|---|---|
| 3,586,027 | | 6/1971 | Fitzgerald, Jr. et al. | 137/87 |
| 4,948,962 | * | 8/1990 | Mitsui et al. | 250/288 |
| 5,185,523 | * | 2/1993 | Kitagawa et al. | 250/281 |
| 5,308,977 | | 5/1994 | Oishi et al. | 250/288 |
| 5,381,008 | | 1/1995 | Tanner et al. | 250/288 |
| 5,565,679 | * | 10/1996 | Tanner et al. | 250/288 |
| 5,572,024 | * | 11/1996 | Gray et al. | 250/288 |

OTHER PUBLICATIONS

Barinaga, C., et al., "Reduced Space Charge Effects in ICP/MS by Selective Elimination of Argon Matrix Ions", Pacific Northwest National Laboratory, Washington, 1996.

Speakman, J., et al., "The Measurement of Difficult' Elements Using a Hexapole Interface/ICP–Mass Spectrometer", Winter Conference Abstracts, p. 357, ICP Information Newsletter, 1998.

* cited by examiner

*Primary Examiner*—Jack Berman
*Assistant Examiner*—Nikita Wells

(57) ABSTRACT

An apparatus and a method for inductively coupled plasma mass spectrometry (ICP-MS) with improved detection limits are disclosed. The ICP-MS includes apparatus for generating an inductively coupled plasma (ICP) in a gas at substantially atmospheric pressure to ionize a sample, a mass analyzer (MS) operable at a low pressure of the order of $10^{-2}$–$10^{-4}$ Pa for detecting at least part of the sample ions, and an interface for transferring the sample ions from the ICP to the MS.

The interface is provided with a controller for increasing the pressure in the interface from its normal pressure, for example, to 350–450 Pa. The increased pressure may reduce the sensitivity of the instrument, but can improve detection limits by selective reduction of interfering ions.

11 Claims, 4 Drawing Sheets

INDUCTIVELY COUPLED PLASMA MASS SPECTROMETER AND METHOD

TECHNICAL FIELD

The present invention relates to inductively coupled plasma mass spectrometry (ICP-MS), and more particularly to an apparatus and methodology for use with such plasma source mass spectrometers which gives rise to improved detection limits.

BACKGROUND OF THE INVENTION

ICP-MS is a technique employed for analyzing inorganic elements, in particular metals, and is widely used in many fields including the semiconductor, geological and environmental industries. ICP-MS offers essentially -simultaneous multi-element analysis for most of the periodic table, produces simple mass spectra, exhibits excellent sensitivity and can determine elemental concentrations at the part-per-trillion (ppt) level.

The ICP-MS employs an inductively coupled argon plasma as an ionization source and a mass spectrometer to separate and measure analyte ions formed in the ICP source. Normally, the sample is taken into solution and pumped into a nebulizer, which generates a sample aerosol. The sample aerosol passes into the ICP, where it is desolvated, atomized and ionized. The resulting sample ions are then transferred from the plasma at atmospheric pressure, to the mass spectrometer that is situated inside a vacuum chamber, via a differentially pumped interface. The ions pass through two orifices in the interface, known as sampling and skimmer cones, and are focused into a quadrupole mass analyzer. The analyzer separates the ions based on their mass/charge ratio prior to measurement by an electron multiplier detection system. Each elemental isotope appears at a different mass with a peak intensity directly proportional to the initial concentration of that isotope in the sample; thus elemental concentrations in the sample can be measured.

While ICP-MS is acknowledged to have higher sensitivity and lower detection limits than conventional elemental analysis techniques such as atomic absorption spectrometry (AAS) and ICP atomic emission spectrometry (ICP-AES, it still suffers from spectroscopic interference. For example, polyatomic ions, such as $ArCl^+$, $ArO^+$ and $C1O^+$, which result from various combinations of atomic species present in the plasma, give rise to spectroscopic interference effects that cannot be sufficiently resolved by the quadrupole mass analyzer. In some cases, problems due to spectroscopic interferences can be overcome by applying mathematical corrections. In many applications, however, a strong need exists to reduce or eliminate spectroscopic interferences. As an example, the ICP-MS is considered to be a useful tool in analyzing and determining trace levels of heavy metal contaminants in drinking water. However, the interference from polyatomic species such as $ArO^+$, $C1O^+$ and $ArAr^+$ on Fe, V and Se respectively, makes it difficult, if not impossible, to produce reliable analytical data at the analyte concentrations typically found in drinking water.

One approach to alleviate the problem of spectroscopic interference is to employ a high-resolution mass spectrometer such as a double focusing magnetic sector analyzer, and equipment of this type is available in the market. However, such equipment is complex by nature, much more costly than quadrupole-based systems, and requires very high operator skill level.

It is also known that the performance of the ICP-MS can be improved by employing a collision cell as an interface for transmitting ions from the plasma source to the quadrupole analyzer[1]. With the collision cell technique, a gas such as helium is introduced into a hexapole collision cell situated between the interface region and the mass spectrometer region. Due to collisions with the helium atoms inside the collision cell, polyatomic species undergo higher attenuation than the analyte ions, thereby reducing the population of polyatomic species before the ions enter the analyzer. However, this technique adds complexity to ICP-MS instruments, and also requires substantial, additional expenditure.

The Japanese Patent Laid-Open Publication No. H10-40,857 describes a technique for improving detection limits in ICP-MS. According to the disclosure, the depth of the skimmer cone orifice is increased so as to cause collisions within the orifice that reduce the number of polyatomic species reaching the mass spectrometer. Although the detection limits of some interfered analyte ions can be improved somewhat by this technique, it is difficult to reproducibly fabricate a skimmer cone with the exact orifice depth required.

A technique for reducing -argon matrix ion ($Ar^+$) interference in the ICP-MS by modifying a conventional sampling interface has also been described[2]. In this case hydrogen or argon gas is introduced via a tube inserted into the intermediate vacuum region behind the skimmer cone. It was demonstrated that argon reduced ion intensity at all masses by collision while hydrogen reduced the level of some ions to a lesser extent than argon. In addition, the introduction of hydrogen gas into the interface region between the sampling cone and the skimmer cone was also investigated, but this resulted in the attenuation of the analyte signal and an increase in the ($Ar^+$)signal.

SUMMARY OF THE INVENTION

It is the intent of the present invention to produce an improved ICP-MS instrument wherein the formation of interfering chemical species is greatly reduced, thereby improving analyte detection limits.

It is also the intent of the present invention to produce an improved ICP-MS instrument that is simple in structure and thus cost-effective, while extending the technique's analyte range at the trace levels required by many applications.

Another intent of the present invention is to provide a novel interface for ICP-MS instrumentation.

Other and further intents will be explained hereinafter and are more particularly delineated in the appended claims.

In summary, the present invention describes an inductively coupled plasma mass spectrometer that comprises a means for generating a plasma at atmospheric pressure, a means for introducing the sample into the plasma for ionization into analyte ions, a means for transferring said ions from the plasma into a chamber (interface stage), held at a second pressure and a means of transferring the ions from the interface into a mass analyser chamber (analyser stage) operating at a third pressure for separation and measurement. Conventionally, ICP-MS instruments have no capability to vary the pressure in any of the stages during operation: the operating pressure in each stage is dependant simply on the pumping speed of the vacuum pumps, which is fixed, and upon the size of the orifices through which the gas molecules are successively pumped. The interface stage pressure is typically in the range of 200 Pa to 300 Pa, while the analyser stage pressure reaches $10^{-2}$–$10^{-4}$ Pa during normal operation.

According to the invention, the interface is provided with a means for varying the pressure in the interface stage (the enclosure between the sampling and skimmer cone orifices). More specifically, the present invention proposes that the ICP-MS be operated at a higher interface pressure than normal B at 350–450 Pa.

As has been described in the literature, the interface serves to extract ions produced in the atmospheric plasma into the high vacuum region, and it is widely accepted that the interface must operate at a pressure of 200–300 Pa or lower to achieve acceptable ion transmission. However, surprising results have been obtained in accordance with the teaching of the present invention by increasing the pressure in the interface stage.

According to one presently preferred embodiment of the present invention, this can be implemented by situating a valve, operated by the ICP-MS system controller, in the interface pump line, to act as a throttle to decrease pumping speed in the interface region, or alternatively by pumping gas into the interface through a gas inlet.

The resulting increase in interface pressure gives rise to more collisional scattering of the ions as they pass through the interface, which would be expected in turn to reduce the sensitivity of the system. According to the present invention, it has been demonstrated that improved detection limits are obtainable, as will be later explained in more detail. While the inventors do not wish to be bound by a particular theory or mechanism, it is speculated that polyatomic ion species that interfere with certain analyte ions are selectively attenuated inside the interface region, and thus prevented from entering into the mass spectrometer. Spectral interferences are greatly reduced, allowing for the reduction in detection limits.

According to another preferred embodiment of the present invention, the pressure in the analyser stage, which is normally fixed, and defined by the diameter of the skimmer cone orifice and the pumping speed of the intermediate and analyzer pumps, can be increased by the introduction of a gas pumped through a-inlet into the main vacuum chamber. Data obtained using this arrangement was contrary to the findings of the aforementioned work[2], and therefore cannot claim to have produced the novel results of the present invention.

According to another preferred embodiment of the present invention, the means for varying localized pressure in the interface effected by changing the sampling and/or skimmer cone design. In a typical example, the sampling cone is modified to give a narrower apex angle inside the tip. Ions extracted from the plasma into this narrow apex behind the tip undergo more collisions since ion beam expansion is restricted. This in turn gives rise to a localized increase in pressure.

Another means to vary localized pressure regions within the interface involves changing the design of the skimmer cone where it protrudes into the Mach Disk. The Mach Disk is a shock wave that forms in the interface stage behind the sampling cone, where the supersonic jet exiting the sampling orifice is slowed by collision with residual gas molecules inside the interface. In operation, the skimmer cone tip protrudes into the Mach Disk, sampling ions from behind it, in the region known as the Azone of silence@, where pressure remains relatively constant. The shape of the skimmer cone can be modified, for example by machining a raised annular ring around the outside of the tip, or by making the outer angle of the cone more shallow. The Mach Disk is disturbed by the modified skimmer cone, increasing collisions within the interface, which in turn increases pressure in the interface stage

BRIEF DESCRIPTION OF THE DRAWINGS

The foregoing discussion can be more readily understood more readily with the aid of the following detailed description of the invention, in conjunction with the accompanying drawings, where.

DETAILED DESCRIPTION OF THE PREFERRED EMBODIMENTS

Figure 1:
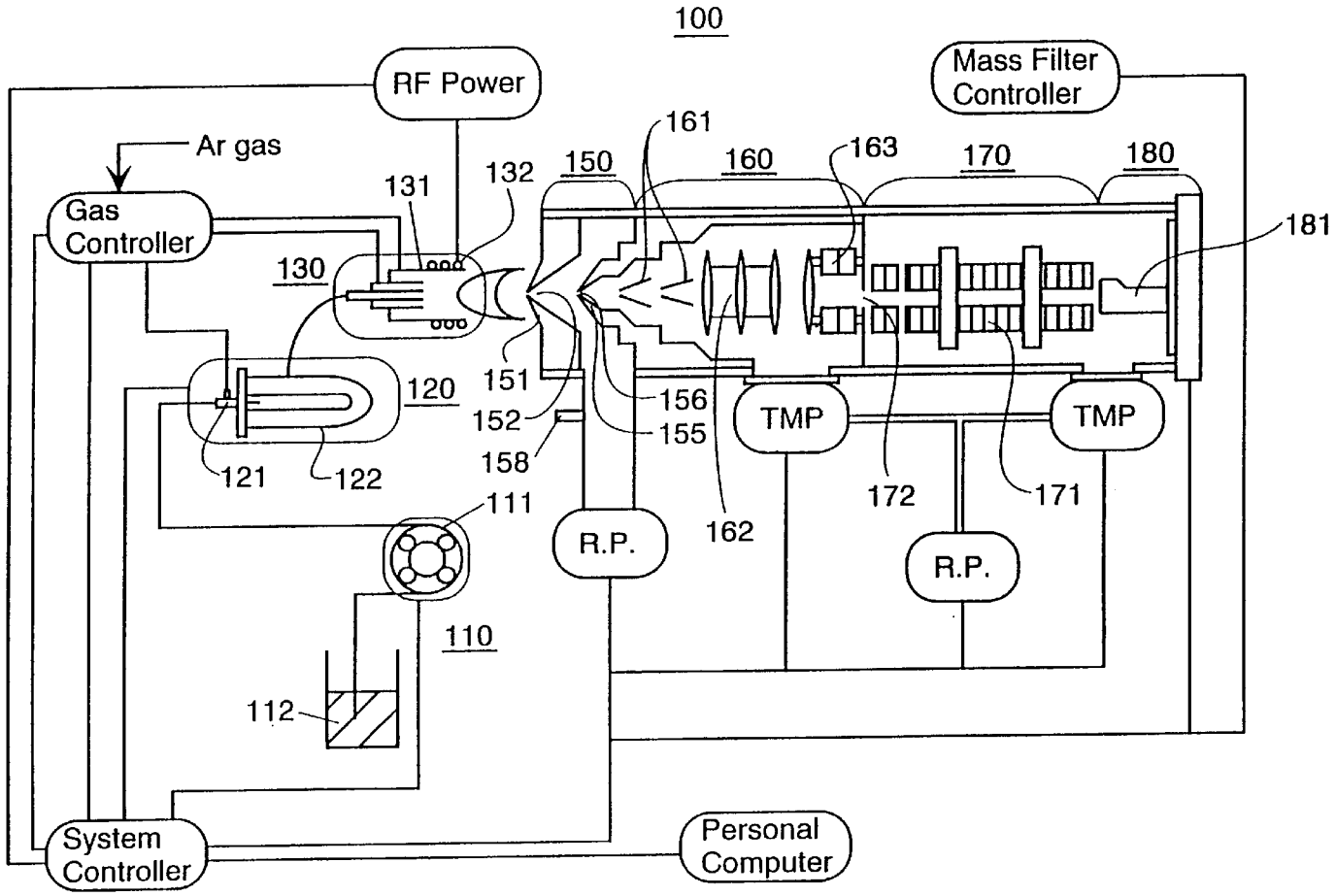
FIG. 1 is a block diagram of a conventional ICP-MS instrument suitable for implementation of the present invention.

FIG. 1 details a conventional ICP-MS instrument 100.As has been described in the art, ICP-MS uses an inductively coupled plasma ion source, and a mass spectrometer for separating the sample ions with respect to their mass, and an interface to transfer sample ions from the ICP section into the MS section.

The instrument features a sample uptake system 110 that features a peristaltic pump 111 for aspiration of a liquid sample 112 into a nebulizer 121 that protrudes into the end of temperature-controlled spray chamber 122. The nebulizer breaks up the liquid sample using Ar gas at high pressure to form a sample aerosol, which is passed through the spray chamber to remove large droplets, before being swept into the ICP section 130. The ICP section comprises of an ICP torch 131, which consists of a series of concentric quartz tubes through which Ar gas flows, located inside an RF coil 132. The RF field generated by the coil excites the Ar atoms passing though the torch, enabling a high energy plasma to be sustained. The sample aerosol is swept into the plasma, where it is desolvated, atomized, and ionized to form sample ions.

The interface section 150 comprises a vacuum chamber which separates the atmospheric plasma from the high vacuum analyser stage containing the mass spectrometer, and a conventional rotary vacuum pump (RP) for maintaining the interface stage at a pressure of typically 200–300 Pa. Ions are extracted from the plasma into the interface stage by the sampling cone 151 through the sampling orifice 152. From the interface stage, the ions are then transferred into the analyzer stage by skimmer cone 155 through skimmer orifice 156. The pressure in the interface stage can be measured by a vacuum gauge 158 mounted in the interface pump line, adjacent to the interface stage. The rotary pump only operates at maximum pumping capacity, so the pressure in the interface stage is not variable. According to the present invention, the pressure in the interface stage during operation can be specifically altered or adjusted as later described.

The MS section comprises an ion lens region 160, a mass filter region 170 and a detector region 180. Ion lens region 180 consists of a vacuum chamber (intermediate stage) containing a series of electrostatic ion lenses mounted behind the skimmer cone which focus the ion beam entering the chamber through the skimmer cone orifice, into the mass filter situated in the analyzer stage. The ion lens arrangement may include an extraction electrode 161, a series of focusing lenses 162, and steering lens 163 mounted off-axis from the skimmer orifice. The intermediate stage is evacuated by a turbomolecular pump (TMP) and a rotary pump, typically to a pressure of $10^{-2}$ Pa. The mass filter region and detector region are both situated inside a third vacuum chamber (analyser stage), which is separated from the intermediate stage by a differential aperture 172. The analyzer stage is evacuated by a second turbomolecular pump at a typical pressure of $10^{-4}$ Pa. The mass filter region contains quadrupole mass filter 171 which essentially consists of four parallel rods, to which RF and DC voltages are applied. For any given combination of RF and DC voltages applied, the filter allows only ions of a specific mass/charge ratio to pass through to the detectors. This allows ions of different elements to be separated and measured by the detector. Detector region 180 contains an electron multiplier detector 181, located directly behind the mass filter. The ion signal at each mass is amplified, and then measured using a multichannel scalar. The signal intensity at a given mass (and therefore element) is directly proportional to the concentration of that element in the sample solution.

Figure 2:
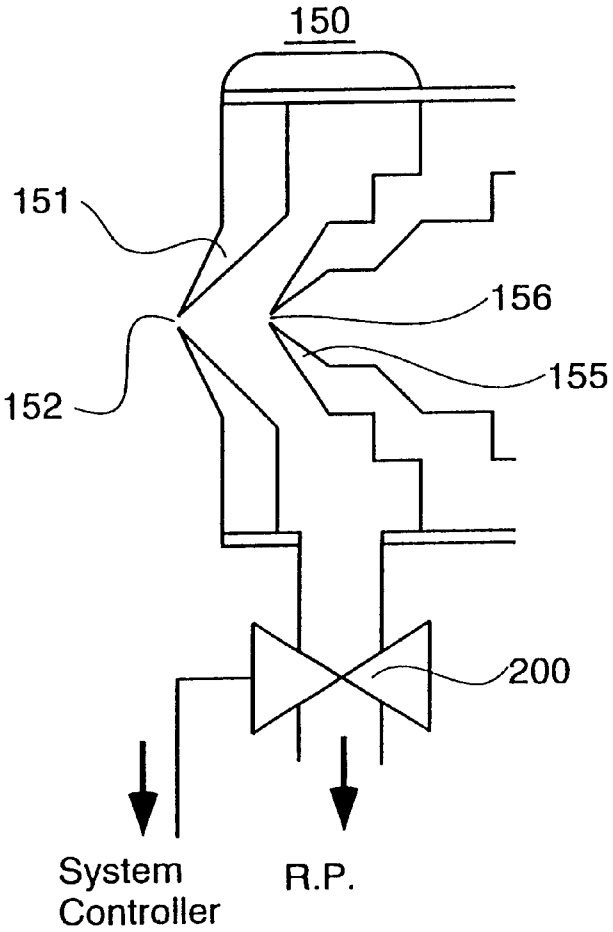
FIG. 2 is a sectional view of a first embodiment of the interface section fitted with a throttling valve in accordance with the present invention.

FIG. 2 shows a preferred embodiment of the interface stage in accordance with the present invention. In all subsequent diagrams, components retain the same reference numbers. As explained earlier, the interface stage is evacuated by a rotary pump, and is maintained at a fixed operating pressure—typically 200–300 Pa. In this embodiment, however, a variable valve 200 is fitted to the pump line, giving variable control of pumping speed. This valve can be controlled by the system controller. Partially closing the valve 200 will reduce pumping speed, and therefore increase the pressure in the interface stage. If the interface stage pressure is increased from the conventional 200–300 Pa, to 400 Pa, ion collisions increase, and polyatomic ion species that give rise to spectral interferences will be dissociated. While the transmission of analyte ions may be reduced, the overall signal/background ratio of many interfered analytes is increased significantly. In the case of an argon ICP, the proposed invention has been found to be suitable for suppressing interferences originating from the argon plasma gas, including, argon ($Ar^+$), argon oxide ($ArO^+$) and argon dimer ($Ar_2^+$), which interfere with isotopes of K, Ca, Fe, and Se. However, the present invention is not limited to the specific interfering ions or interfered elements described.

Figure 3:
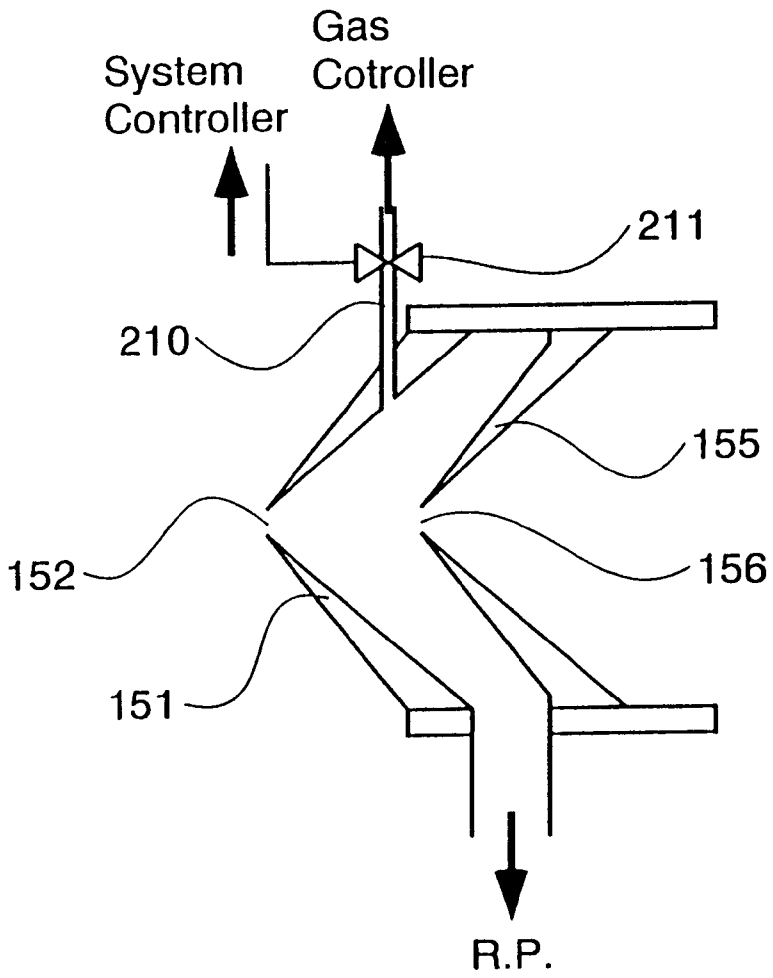
FIG. 3 is a sectional view of a second embodiment of the interface section fitted with a gas inlet in accordance with the present invention.

FIG. 3 shows an alternative embodiment wherein an inlet 210 is fitted to the interface stage to enable the introduction of a gas. In the illustrated example, the inlet is located at the base of sampling cone 151 diametrically opposite the interface pump port, and the gas flow rate through the inlet is adjustable by a computer-controlled variable valve 211. While additional pipework is required, this embodiment has the advantage that it enables precise control of the local pressure in the region between the sampler and skimmer orifices, where the ion beam is located.

The introduction of gas into the interface stage results in an increase of pressure, similar to that achieved by the reduction of interface pumping speed, as described above. Likewise, ion collisions increase, and polyatomic ion species that give rise to spectral interferences will be dissociated. And while the transmission of analyte ions may be reduced, the overall signal/background ratio of many interfered analytes is increased significantly. Since the ICP-MS normally uses an argon plasma, the gas introduced to the interface stage is usually argon, but other gases such as hydrogen, helium or oxygen can also be used. The embodiment of FIG. 3, as well as the embodiment of FIG. 2, enable an infinite variation of the interface stage under computer control. Thus the pressure can be altered automatically and analytical measurements performed to enable system optimization for any given analyte or combination of analytes.

Figure 4:
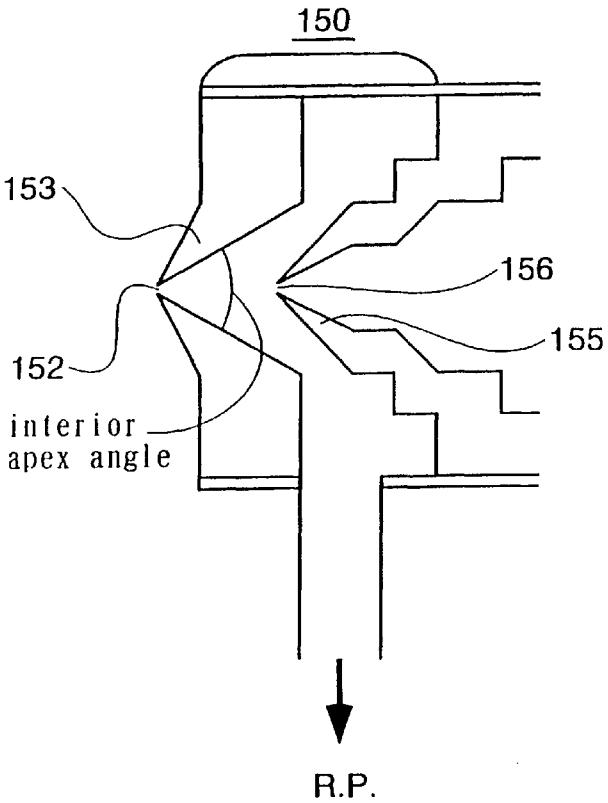
FIG. 4 is a sectional view of a third embodiment of the interface section featuring a modified sampling cone in accordance with the present invention.

FIGS. 4 and illustrate another embodiment in accordance with the present invention, wherein the pressure in the interface stage, in particular the local pressure in the region between the sampler and skimmer orifices is changed by replacing the conventional sampling and/or skimmer cones as shown in FIG. 1 with modified sampling and/or skimmer cones. FIG. 4 denotes the interface stage fitted with a modified sampling cone 153 that has a narrowed apex angle inside the cone. Conventionally, the interior apex angle is about 70 E or larger and this allows for efficient pumping behind the sampler cone. In the modified sampling cone, however, the interior apex angle is narrowed to between 50–60 E. The narrower angle reduces the pumping efficiency behind the sampling orifice, leading to increased pressure in the region between the cone orifices. As in the FIG. 3 embodiment, this increased pressure is considered to increase ion collisions in this region, which in turn results in dissociation of polyatomic ion species that give rise to spectral interferences.

Figure 5:
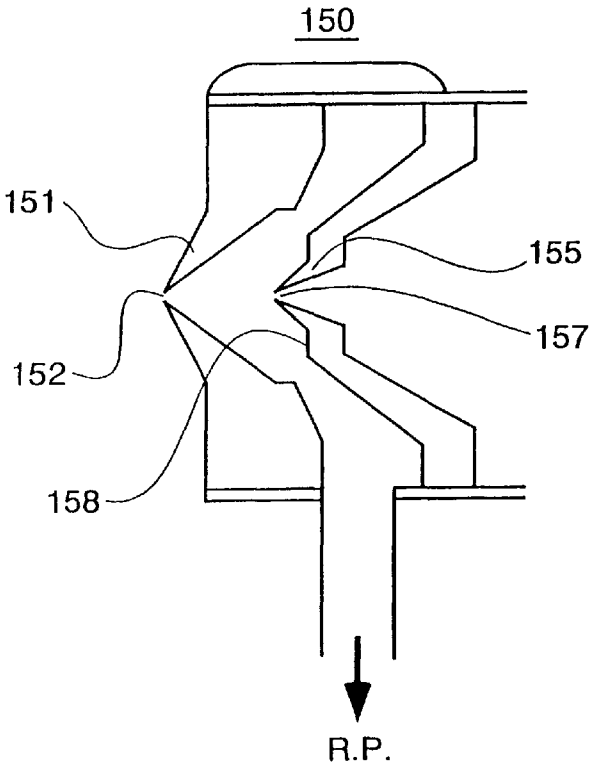
FIG. 5 is a sectional view of a fourth embodiment of the interface section provided with an alternatively modified skimmer cone in accordance with the present invention

FIG. 5 shows a modified skimmer cone 157, which has a raised shoulder 158 around the outer surface of the cone, in the proximity of the cone tip. While other skimmer cones, previously described in the art could be considered to feature a raised shoulder, these differ from the present invention in that the shoulder in these other designs is in fact part of the securing base, and the shoulder is located away from the tip. The present invention proposes the use of a shoulder on the skimmer cone to physically interfere with the formation of the Mach Disk, which is a shock wave that forms in the interface stage behind the sampling cone, where the supersonic jet exiting the sampling orifice is slowed by collision with residual gas molecules inside the interface. In operation, the skimmer cone tip protrudes into the Mach Disk, sampling ions from behind it, in the region known as the Azone of silence@, where pressure remains relatively constant.

In the illustrated embodiment, the shoulder, being-close to the skimmer cone tip at the point where the Mach Disk is located, has the effect of creating a shock wave which increases the local pressure. The surface of the shoulder is essentially perpendicular to the axial direction along which the plasma gases enter the interface stage, so that gas molecules impinge and are reflected backwards from the shoulder to increase the local pressure between the cone orifices. Provided similar functionality can be obtained, the shoulder may be angled or, alternatively, could form the entire outer surface of the skimmer cone, resulting in a skimmer cone with an obtuse exterior apex angle B even up to 180°.

Although it is not shown in the drawing diagrams, it should be understood that the present invention also envisages a combination of a modified sampling cone as shown in FIG. 4 and a modified skimmer cone as shown in FIG. 5. In that case, the sampling cone could feature a narrowed internal apex angle, and the skimmer cone could feature an annular shoulder positioned close to the skimmer tip. By this arrangement, a shock wave would be generated at a position upstream of the skimmer tip, and both of the cones could contribute to increase the local pressure between the between the cone orifices in accordance with the present invention.

EXAMPLE

Example 1

An ICP-MS model HP 4500, available from Yokogawa-nalytical Systems Inc. (Tokyo, Japan) and Hewlett-Packard Company (Palo Alto, Calif.) was modified by fitting a variable valve in the line between the interface stage and the rotary pump as shown in FIG. 2. The degree of opening of the variable valve was adjusted via the system software until the pressure in the interface stage, measured between the sampling and skimmer cones, increased to 400 Pa. With the valve fully open, the pressure in the vacuum chamber was 300 Pa.

To determine the detection limit of $^{56}Fe$, which suffers interference from the polyatomic species $ArO_{+}$, a blank solution and a sample solution containing ppb Fe were prepared and measurements were made under the following operating conditions:

| | |
|---|---|
| ICP RF Power | 1.6 kW |
| Carrier Gas | Argon |
| Carrier Gas Flow Rate | 1.4 l/min |
| Sampling Depth | 8 mm |

With the modified ICP-MS, the sensitivity and detection limit (3[) of $^{56}Fe$ were found to be 13000 cps/ppb and 0.36 ppb, respectively. The intensity of background $ArO^{-}$ was found to be 280000 cps. Without modification, the sensitivity and detection limit of $^{56}Fe$ were found to be 135000 cps/ppb and 1.38 ppb, respectively, and the intensity of ArO was 7120000 cps. This result indicates that while the modified instrument exhibits a reduced sensitivity for $^{56}Fe$, it also effectively improves the detection limit of $^{56}Fe$ by factor of 4, because of the significant reduction of he $ArO^{+}$ background relative to $^{56}Fe$.

Example 2

The sampling cone of the ICP-MS instrument employed in Example 1 above was replaced with a sampling cone having an interior apex angle of 55 E. The original cone had an interior apex angle of 70 E. The modified ICP-MS was operated and the 10 ppb Fe standard measured under the same conditions as in Example 1. The modified ICP-MS demonstrated an improved detection limit for $^{56}Fe$ over the standard ICP-MS instrument by a factor similar to that observed in Example 1.

Example 3

The skimmer cone of the ICP-MS instrument described in Example 1 above was replaced with a modified skimmer cone featuring an annular shoulder as shown in FIG. 5. The base of the original skimmer cone might also be considered to be an annular shoulder, but the axial distance between the cone tip and the base was 5.5 mm and so the shoulder was thus situated downstream of the Mach disc. In the modified skimmer cone, the axial distance between tip and shoulder was 1.5 mm so that the shoulder would generate a shock wave upstream of the skimmer tip. The modified ICP-MS demonstrated an improved detection limit for $^{56}Fe$, as in the case of the modified ICP-MS in Example 1.

It will therefore be seen that the foregoing represents a highly extensible approach for improving the performance of the interface region in ICP-MS. The terms and expressions employed herein are used as terms of description and not of limitation, and there is no intention, in the use of such terms and expressions, of excluding any equivalents of the features shown and described or portions thereof, and it is recognized that various modifications are possible within the scope of the invention claimed. For example, while the present invention has been specifically explained in connection with working examples involving $ArO^{+}$ as the interfering ion, those skilled in the art may well attempt to reduce, in accordance with the technique of the present invention, interferences arising from other known species such as argon ($Ar^{+}$), argon carbide ($ArC^{+}$), argon nitride ($ArN^{+}$), argon chloride ($ArCl^{+}$) and argon dimer ($Ar_2^{+}$) for the purpose of improving the measurement of analyte ions including $^{40}Ca$, $^{52}Cr$, $^{54}Fe$, $^{56}Fe$, $^{75}As$ and $^{80}Se$, and all such applications are considered to fall within the scope of the present invention.

REFERENCES

Speakman et al. The Measurement of ADifficult@ Elements Using a Hexapole Interface/ICP-Mass Spectrometer. 1998 Winter Conference on Plasma Spectrochemistry, Scottsdale, Ariz., Barinaga et al. Reduced Space Charge Effects in ICP/MS by Selective Elimination of Argon Matrix Ions. 1996 American Society for Mass Spectrometry Conference, Portland Oreg.

We claim:

1. An inductively coupled plasma mass spectrometer that comprises:

a means for generating a plasma at a first, substantially atmospheric pressure;

a means for introducing the sample into the plasma for ionization into analyte ions;

a means for transferring said ions from the plasma into an interface stage, being set at a second pressure, defined between a sampling cone situated on the side of generation of the plasma, and a skimmer cone situated facing to the sampling cone; and a means of transferring the ions from the interface stage into a mass analyzer stage operating at a third pressure being lower than the first pressure and the second pressure, separated from the interface stage by the skimmer cone, having an ion lens region and a detector region for separating and measuring the analyte ions, wherein the skimmer cone and the sampling cone are configured to increase a local pressure between orifices of the skimmer cone and the sampling cone by generating a shock wave at a position upstream of the skimmer tip.

2. The inductively coupled plasma mass spectrometer as claimed in claim 1, in which the interior apex angle of the sample cone is narrowed to restrict ion beam expansion.

3. The inductively coupled plasma mass spectrometer as claimed in claim 2, in which the interior apex angle of the sample cone is 50 to 60°.

4. The inductively coupled plasma mass spectrometer as claimed in claim 1, in which the skimmer cone features an annular shoulder to reflect gas molecules and generate the shock wave.

5. The inductively coupled plasma mass spectrometer as claimed in claim 1, in which the second pressure is 350 to 450 Pa.

6. The inductively coupled plasma mass spectrometer as claimed in claim 1, in which the plasma is argon plasma.

7. The inductively coupled plasma mass spectrometer as claimed in claim 1, in which the analyte ions are at least one selected from the group consisting of $^{40}Ca$, $^{52}Cr$, $^{54}Fe$, $^{56}Fe$, $^{75}As$ and $^{80}Se$.

8. The inductively coupled plasma mass spectrometer as claimed in claim 1, in which the interfering ions containing at least one selected from the group consisting of argon, argon carbide, argon nitride, argon chloride and argon dimmer is prevented from entering into the analyzer stage from the interface stage by way of the shock wave.

9. A method for inductively coupled plasma mass spectrometry, which comprises the steps of:

generating a plasma at a first, substantially atmospheric pressure;

introducing the sample into the plasma for ionization into analyte ions;

transferring said ions from the plasma into an interface stage, being set at a second pressure, defined between a sampling cone situated on the side of generation of the plasma, and a skimmer cone situated facing to the sampling cone;

increasing a local pressure between orifices of the skimmer cone and the sampling cone by generating a shock wave at a position upstream of the skimmer tip of the interface stage with part of the plasma; and transferring the ions from the interface stage into a mass analyzer stage, being operated at a third pressure lower than the first pressure and the second pressure, being separated from the interface stage by the skimmer cone, and having an ion lens region and a detector region for separating and measuring the analyte ions.

10. The method as claimed in claim 9, in which the plasma is argon plasma.

11. The method as claimed in claim 9, in which the analyte ions are at least one selected from the group consisting of: $^{40}Ca$, $^{52}Cr$, $^{54}Fe$, $^{56}Fe$, $^{75}As$ and $^{80}Se$.

* * * * *

UNITED STATES PATENT AND TRADEMARK OFFICE

CERTIFICATE OF CORRECTION

PATENT NO. : 6,265,717 B1
DATED : July 24, 2002
INVENTOR(S) : Sakata et al.

It is certified that error appears in the above-identified patent and that said Letters Patent is hereby corrected as shown below:

Title page,
Please add the following: -- This is a continuation in part of serial number 09/115,443, filed July 15, 1998, now abandoned --.

Signed and Sealed this

Twenty-fifth Day of June, 2002

*Attest:*

*Attesting Officer*

JAMES E. ROGAN
*Director of the United States Patent and Trademark Office*